US006882338B2

(12) United States Patent
Flowers

(10) Patent No.: US 6,882,338 B2
(45) Date of Patent: Apr. 19, 2005

(54) ELECTROGRAPHIC POSITION LOCATION APPARATUS

(75) Inventor: Mark Flowers, Los Gatos, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 118 days.

(21) Appl. No.: 10/222,205

(22) Filed: Aug. 16, 2002

(65) Prior Publication Data

US 2004/0032369 A1 Feb. 19, 2004

(51) Int. Cl.[7] ..... G09G 5/00
(52) U.S. Cl. ..... 345/174; 178/18.01; 343/701
(58) Field of Search ..... 345/156, 173, 345/174; 178/18.01–18.07, 19.01–19.04; 343/701

(56) References Cited

U.S. PATENT DOCUMENTS

| | | | | |
|---|---|---|---|---|
| 4,603,231 | A | 7/1986 | Reiffel et al. | |
| 4,650,926 | A | 3/1987 | Nakamura et al. | |
| 5,686,705 | A * | 11/1997 | Conroy et al. | 178/18.05 |
| 5,877,458 | A | 3/1999 | Flowers | |
| 6,215,978 | B1 * | 4/2001 | Ruzic et al. | 434/311 |
| 6,608,618 | B1 | 8/2003 | Wood et al. | |
| RE38,286 | E | 10/2003 | Flowers | |
| 6,641,401 | B1 | 11/2003 | Wood et al. | |
| 6,661,405 | B1 | 12/2003 | Flowers | |
| 6,668,156 | B1 | 12/2003 | Lynch et al. | |
| 2003/0001824 | A1 * | 1/2003 | Chao et al. | 345/173 |
| 2003/0016210 | A1 | 1/2003 | Soto et al. | |
| 2003/0198928 | A1 | 10/2003 | Lynch et al. | |
| 2003/0206161 | A1 * | 11/2003 | Liu et al. | 345/173 |
| 2003/0218604 | A1 | 11/2003 | Wood et al. | |
| 2004/0032369 | A1 | 2/2004 | Flowers | |

FOREIGN PATENT DOCUMENTS

WO WO 01/84529 A1 11/2001

* cited by examiner

*Primary Examiner*—Ricardo Osorio
(74) *Attorney, Agent, or Firm*—Townsend and Townsend and Crew LLP

(57) ABSTRACT

Antenna devices and apparatuses using the antenna devices are disclosed. In one embodiment, the antenna device includes a first plate structure and a second plate structure. A conductive member is adapted to be capacitively coupled to the first plate structure at a first capacitance and is adapted to be capacitively coupled to the second plate structure at a second capacitance. The conductive member is adapted to transmit a signal based on the first capacitance and the second capacitance.

37 Claims, 15 Drawing Sheets

ELECTROGRAPHIC POSITION LOCATION APPARATUS

CROSS-REFERENCE TO RELATED APPLICATIONS

None.

BACKGROUND OF THE INVENTION

U.S. patent application Ser. No. 09/574,499, filed May 19, 2000, entitled "Electrographic Position Location Apparatus and Method," which is assigned to the same assignee as the present application and is herein incorporated by reference in its entirety, describes an apparatus that comprises an antenna system that uses a resistive voltage divider. Such antenna systems could be used in interactive products such as talking globes.

FIG. 1 is a schematic illustration that shows how a resistive voltage divider might be used in an antenna system in an electrographic position location apparatus. FIG. 1 shows a portion of an antenna system including a resistive voltage divider 850 between two terminal nodes 802, 804. The two terminal nodes 802, 804 can be driven by respective AC voltage sources. The resistive voltage divider 850 includes four resistors R1 810, R2 812, R3 814, and R4 816 having the same resistance values. Three conducting finger elements 830, 832, 834 are respectively interspersed between the resistors R1–R4 810, 812, 814, 816. Each finger element 830, 832, 834 can radiate AC electric field energy.

Each conductive finger element 830, 832, 834 can correspond to a specific location and can transmit a signal that is different than other finger elements. An AC signal can be applied to the resistive voltage divider 850 to cause each finger element 830, 832, 834 to radiate a constant field along its length. For example, an AC bias may be applied to node 802 while node 804 is grounded. The field generated by each finger element 832, 834, 830 varies according to the point at which it is coupled to the voltage divider 850. In this example, the finger elements 832, 834, 830 are straight and parallel. When the signal is applied to the voltage divider 850, a series of parallel equipotential lines characteristic of the signals transmitted by finger elements 830, 832, 834 are generated. The equipotential lines may have characteristics corresponding to the voltages V1–V3, respectively.

When a stylus (not shown) comprising a receiving antenna is placed over, for example, the finger element 830, a signal with a voltage V1 is transmitted by the finger element 830 and is received by the receiving antenna in the stylus. A microprocessor is operationally coupled to the stylus and the finger element 830. It receives the signal information and determines that the stylus is over the finger element 830. The microprocessor can retrieve an appropriate output corresponding, for example, to a printed feature that is over the finger element 830. This output can then be presented to the user.

A housing may be disposed over the finger elements 830, 832, 834. In an illustrative example, the images of the United States, Mexico and Brazil may be printed on the housing and may be respectively located over the finger elements 830, 832, 834. When the user uses the stylus to select the image of the United States, the receiving antenna in the stylus receives the signal of the voltage V1 transmitted by the finger element 830. After receiving the signal, a microprocessor associated with the antenna system can determine that the stylus is over the finger element 830. It can cause a speaker in the system to sound the phrase "the United States" for the user.

The resistive voltage divider 850 can be fabricated as a resistive strip. A cross-section of exemplary resistive voltage divider 850 is shown in FIG. 2. The resistive voltage divider 850 includes resistors R1–R4 810, 812, 814, 816. The resistors R1–R4 810, 812, 814, 816 can be made of a conductive carbon-based ink and can have different thicknesses due to inherent inaccuracies in the resistor printing process. The thickness differences can lead to undesired resistance variations in R1–R4 810, 812, 814, 816.

Although the resistive voltage divider 850 is suitable for its intended purpose, a number of improvements could be made. First, it would be desirable to provide for an apparatus that is less expensive to produce. Each one of the resistors R1–R4 810, 812, 814, 816 in the resistive voltage divider 850 goes through a calibration process to ensure, among other things, that the resistance values of R1–R4 810, 812, 814, 816 are within an acceptable range. The calibration data is stored in an EEPROM (electronically erasable programmable read-only memory) chip in the apparatus. This calibration process is time consuming and expensive. In addition, the use of an additional EEPROM chip in an electrographic position location apparatus increases the cost of the apparatus. Accordingly, it would be desirable to omit it if possible. Second, it would be desirable to improve the "resolution" of an electrographic position location apparatus. The resolution of an electrographic position location apparatus is generally the ability of the electrographic position location apparatus to distinguish between different, closely adjacent positions on a surface. The closer the positions that the electrographic position location apparatus are able to distinguish, the higher the resolution. To have high resolution, the differences in the heights of the resistors (and in the local conductance of material used in resistors) R1–R4 810, 812, 814, 816 in the resistive voltage divider 850 are generally very small in order to achieve the desired voltage differences in the finger elements 830, 832, 834. It is difficult to print resistors R1–R4 with identical heights and resistance values. Accordingly, it is difficult to achieve high resolution (e.g., 1/10th inch accuracy across a 10 inch surface) in an electrographic position location apparatus. Lastly, because the resistors are desirably uniform in resistance, the conductive material used to form R1–R4 810, 812, 814, 816 is expensive. It would be desirable if a less expensive conductive material could be used to reduce the cost of any apparatus formed.

Embodiments of the invention address one or more of the problems described above, as well as other problems, individually and collectively.

SUMMARY OF THE INVENTION

Embodiments of the invention include antenna devices and apparatuses incorporating the antenna devices.

One embodiment of the invention is directed to an antenna device comprising: (a) a first plate structure; (b) a second plate structure; (c) a conductive member adapted to be capacitively coupled to the first plate structure at a first capacitance and adapted to be capacitively coupled to the second plate structure at a second capacitance, wherein the conductive member is adapted to transmit a signal; and (d) a dielectric layer between the conductive member, and the first and second plate structures.

Another embodiment of the invention is directed to an antenna device comprising: (a) a plurality of first plate structures; (b) a plurality of second plate structures; (c) a plurality of conductive members overlapping the plurality of first plate structures and the plurality of second plate structures; and (d) a dielectric layer between the plurality of conductive members and the plurality of first plate structures and the plurality of second plate structures, wherein each conductive member is adapted to transmit a different signal.

Another embodiment of the invention is directed to an antenna device comprising: (a) a plurality of first plate structures; (b) a plurality of second plate structures, each first plate structure being cooperatively structured with respect to one of the second plate structures, and wherein the plurality of first plate structures and the plurality of second plate structures respectively form a plurality of pairs of plate structures, each pair of plate structures being adapted to transmit a different signal that is adapted to be received by a receiving antenna; and (c) a dielectric layer, wherein the plurality of first plate structures and plurality of second plate structures are on the dielectric layer.

Another embodiment of the invention is directed to an antenna device comprising: (a) a plurality of first plate structures; (b) a plurality of second plate structures, each first plate structure being cooperatively structured with respect to one of the second plate structures, and wherein the plurality of first plate structures and the plurality of second plate structures respectively form a plurality of pairs of plate structures, each pair of plate structures being adapted to transmit a different signal that is adapted to be received by a receiving antenna; and (c) a dielectric layer, wherein the plurality of first plate structures and plurality of second plate structures are on the dielectric layer.

Another embodiment of the invention is directed to an electrographic position location apparatus comprising: (a) a first antenna device comprising a plurality of first antenna members comprising a first plurality of first plate structures, a first plurality of second plate structures, and a first plurality of conductive members; (b) a second antenna device comprising a plurality of second antenna members comprising a second plurality of first plate structures, a second plurality of second plate structures, and a second plurality of conductive members, wherein portions of the first plurality of conductive members and the second plurality of conductive members overlap to define an active area; (c) an output device; (d) a processor operatively coupled to the first antenna device, the second antenna device, and the output device; and a stylus operatively coupled to the processor.

Other embodiments of the invention are directed to apparatuses incorporating the antenna devices.

Other embodiments of the invention are directed to interactive globes.

These and other embodiments of the invention are described in further detail below with reference to the Figures and the Detailed Description.

BRIEF DESCRIPTION OF THE DRAWINGS

FIG. 3(*b*) shows an electrical schematic of an antenna device.

FIG. 3(*c*) shows a simplified circuit diagram of the antenna device shown in FIG. 2(*a*).

FIG. 3(*d*) shows a plan view of a plurality of conductive members and a grounding element around the plurality of conductive members.

FIG. 10(*b*) shows a top view of conductive structures overlapping a conductive member in an antenna member.

DETAILED DESCRIPTION

Figure 1:
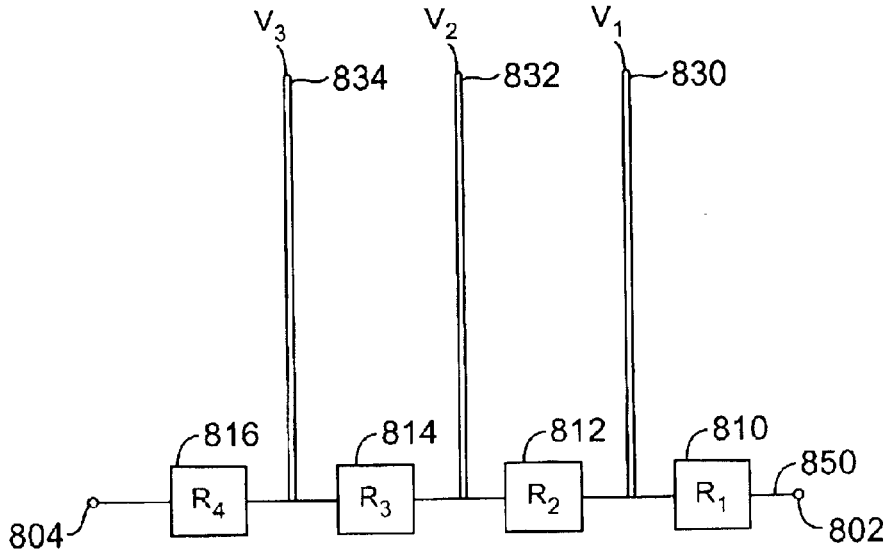
FIG. 1 shows a portion of an electrographic position location apparatus using a resistive voltage divider.
Figure 2:
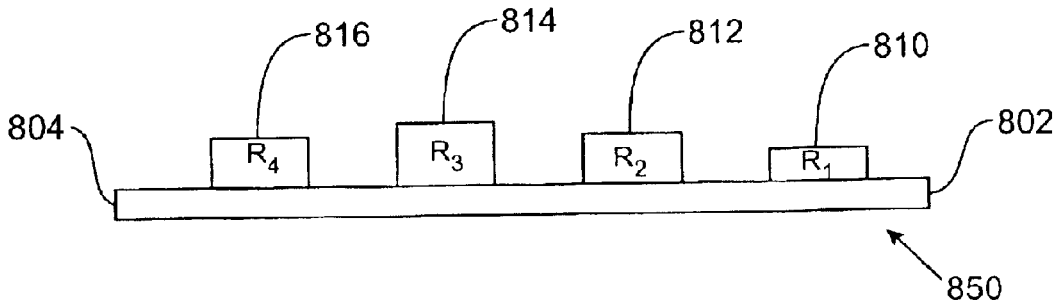
FIG. 2 shows a side cross-sectional view of a resistive voltage divider.
Figure 3A:
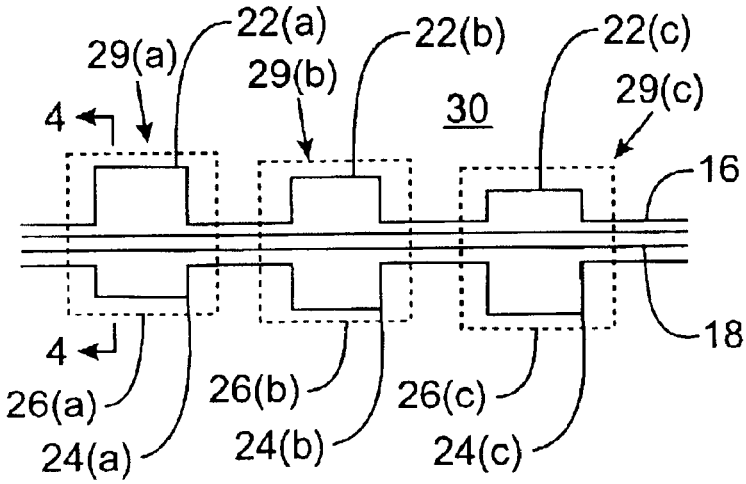
FIG. 3(*a*) shows a top view of a portion of an antenna device.
Figure 3B:
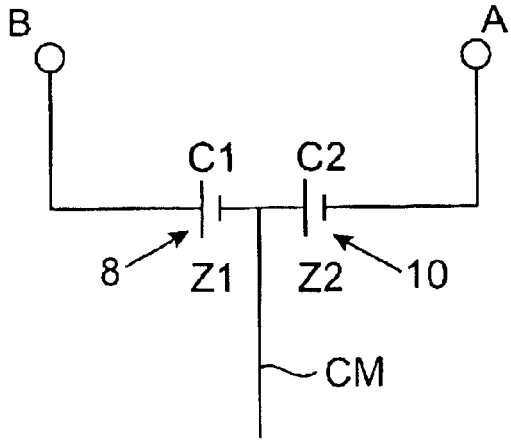
Figure 3C:
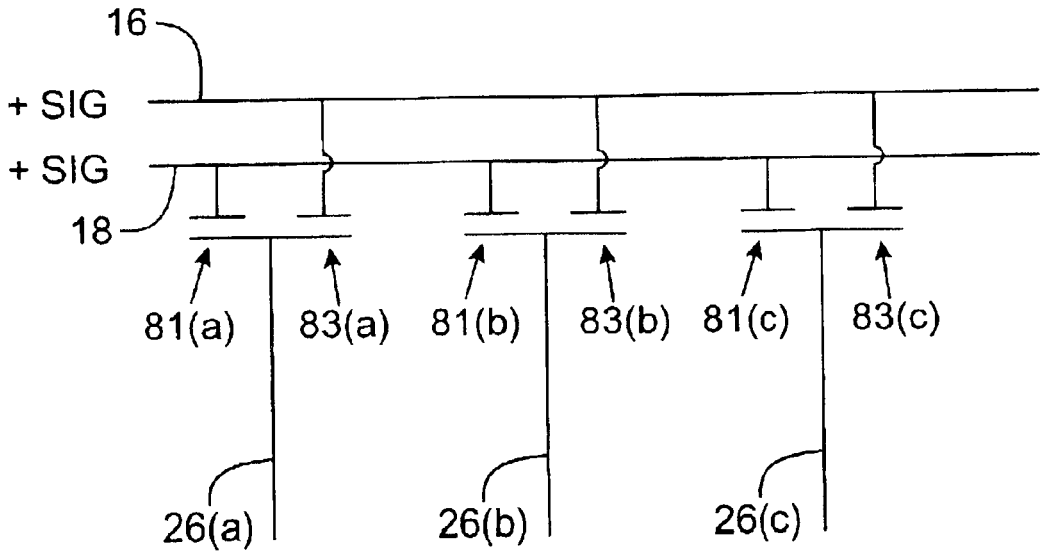
Figure 3D:
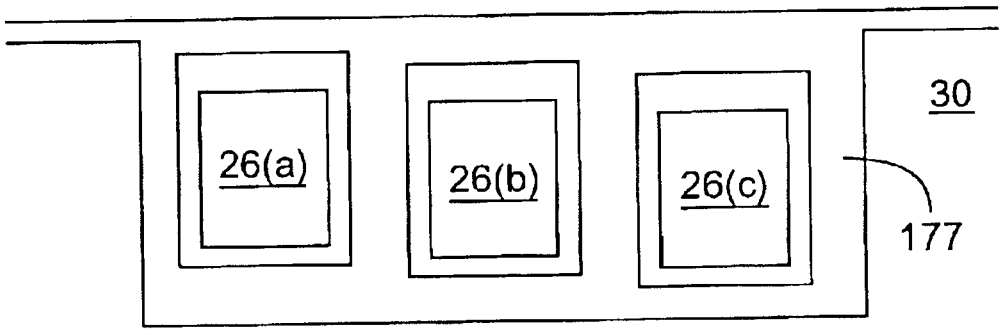

As used herein, the word "antenna" is not intended to be limiting and is intended to include a conductor that transmits or receives AC signals, at any suitable frequency, to or from another conductor via capacitive coupling, or any other type of coupling mechanism. The receiving conductor and the transmitting conductor may be separated by any suitable distance. For example, in some embodiments, an antenna device may transmit a signal to a stylus that is separated from the antenna device by a distance of 1 inch or less. Also, the word "transmit" is intended to include, among other things, the radiation of AC (capacitively) coupled energy.

Embodiments of the invention are directed to antenna devices and electrographic position location apparatuses using the antenna devices. In embodiments of the invention, an antenna device includes a plurality of antenna members. Each antenna member can include a first and a second plate structure. Each first plate structure can have a different area than other first plate structures in other antenna members. Each second plate structure can have a different area than other second plate structures in other antenna members. In embodiments of the invention, the first plate structure or the second plate structure can be continuous or discontinuous, and can be part of one or more larger conductive structures. The nature (e.g., the signal strength) of the signals emitted from the first and second plate structures can depend on the respective areas of the first and second plate structures. Accordingly, plate structures with different areas may transmit different signals indicative of the locations of the antenna members that have those plate structures. In embodiments of the invention, a stylus including a receiving antenna can receive a combined signal that is derived from signals transmitted from corresponding pairs of first and second plate structures in the antenna members. Each combined signal from each antenna member can be indicative of the location of at least a portion of that antenna member.

In some embodiments, a conductive member may be used to "collect" the signals transmitted by a pair of first and second plate structures in an antenna member. For example, some embodiments of the invention are directed to an antenna device comprising a first conductor including first plate structures and a second conductor including second plate structures. Conductive members are adapted to be capacitively coupled to the first and second plate structures, and the first and second conductors. Each conductive member can form an antenna member with a corresponding first plate structure and a second plate structure. Each conductive member can receive a signal from a first plate structure and a second plate structure, and can be adapted to transmit a different signal (e.g., a difference in phase, amplitude, etc.) than other conductive members. A receiving antenna in, for example, a stylus can receive the different signals provided by the conductive members. Using received signal information and knowing the positions of the conductive members, a microprocessor associated with the receiving antenna and the conductive member can determine which location was selected with the stylus.

FIG. 3(*a*) shows an antenna device according to one embodiment of the invention. The antenna device includes a first conductor 16 and a second conductor 18. The first conductor 16 includes a plurality of first plate structures 22(*a*)–22(*c*). The second conductor 18 includes a plurality of second plate structures 24(*a*)–24(*c*). The first and second conductors 16, 18 are on a dielectric layer 30. Two alternating voltage sources (not shown) may be respectively coupled to the first and second conductors 16, 18 so that different AC signals can be applied to them.

Each pair of first and second plate structures 22(*a*)–24(*a*), 22(*b*)–24(*b*), 22(*c*)–24(*c*) can form an antenna member 29(*a*)–29(*c*) with an associated conductive member 26(*a*)–26(*c*). For example, the conductive member 26(*a*), the first plate structure 22(*a*), and the second plate structure 24(*a*) can form a first antenna member 29(*a*). Each conductive member 26(*a*)–26(*c*), and therefore each antenna member 29(*a*)–29(*c*) may be adapted to transmit a different signal.

The conductive members 26(*a*)–26(*c*) are respectively adapted to be capacitively coupled to pairs of first and second plate structures 22(*a*)–24(*a*), 22(*b*)–24(*b*), 22(*c*)–24(*c*), and also the first and second conductors 16, 18. The conductive members 26(*a*)–26(*c*) are shown by invisible lines and are on the opposite side of the dielectric layer 30 as the first and second plate structures 22(*a*)–22(*c*), 24(*a*)–24(*c*). When the antenna device is in use, each conductive member 26(*a*)–26(*c*) can form a first capacitor with a first plate structure 22(*a*)–22(*c*). Each conductive member 26(*a*)–26(*c*) can form a second capacitor with a second plate structure 24(*a*)–24(*c*). Thus, the first plate structures 22(*a*)–22(*c*) form a plurality of first capacitors and the second plate structures 24(*a*)–24(*c*) form a plurality of second capacitors. The first plate structures 22(*a*)–22(*c*) and the second plate structures 24(*a*)–24(*c*) can be capacitively coupled to the conductive members 26(*a*)–26(*c*). In some embodiments, except for capacitive coupling, each conductive member 26(*a*)–26(*c*) can be electrically isolated from the first and second plate structures 22(*a*)–22(*c*), 24(*a*)–24(*c*) and from other conductive structures in the electrographic position location apparatus. Thus, the conductive members 26(*a*)–26(*c*) can be considered "floating" since there may be no direct electrical connection to them.

In the antenna device, the area of each first plate structure 22(*a*)–22(*c*) can be different than the areas of other first plate structures. The area of each second plate structure 24(*a*)–24(*c*) can be different than the areas of other second plate structures. The capacitance of a capacitor depends on the area of the capacitor plates forming the capacitor. Consequently, each first capacitor formed from each first plate structure can have a different capacitance than other first capacitors formed by other first plate structures. Also, each second capacitor formed by each second plate structure can have a different capacitance than other second capacitors formed by other second plate structures.

A first plate structure 22(*a*)–22(*c*) and a second plate structure 24(*a*)–24(*c*) within a capacitor pair 22(*a*)–24(*a*), 22(*b*)–24(*b*), 22(*c*)–24(*c*) can have different areas. Thus, the first plate structures 22(*a*)–22(*c*) and the second plate structures 24(*a*)–24(*c*) may overlap with the conductive members 26(*a*)–26(*c*) by different amounts. For example, a first plate structure may overlap a conductive member by a first overlap area while a second plate structure may overlap the conductive member by a second overlap area. The first plate structure and the conductive member form a first capacitor with a first capacitance and a second plate structure and the conductive member form a second capacitor with a second capacitance.

Each first capacitor and each second capacitor in each capacitor pair 22(*a*)–24(*a*), 22(*b*)–24(*b*), 22(*c*)–24(*c*) can also have different capacitances. Each conductive member 26(*a*)–26(*c*) can be adapted to transmit a different signal based on the first capacitance and the second capacitance associated with it. The transmitted signals can be different than the signals that are present in the corresponding first and second plate structures 22(*a*)–22(*c*), 24(*a*)–24(*c*).

In embodiments of the invention, at least a pair of capacitors can cause an AC output voltage in a conductive member to differ from an AC voltage in either of the first or second plate structures. For example, referring to the electrical schematic shown in FIG. 3(*b*) a signal (e.g., a sinusoidal signal) at 10 V AC can be applied to point A while point B can be at 0 V. A conductive member CM may be between two capacitors 8, 10 and/or may form the bottom plates of the capacitors 8, 10. The capacitance values of the capacitors 8, 10 may be C1 and C2. When the input signal of 10 V is applied to point A, the capacitors may have impedance values Z1 and Z2 associated with them. The voltage $V_{CM}$ of conductive member CM can be characterized by the following equation:

$$V_{CM}=V_A*C2/(C1+C2)$$

As shown by this equation, the voltage of an input signal $V_A$ to one of a first plate structure or a second plate structure can be modified by capacitors with capacitance values C1 and C2. Accordingly, in embodiments of the invention, different signals with different amplitudes can be produced for different conductive members using capacitors with different capacitances.

Embodiments of the invention have a number of advantages. First, in comparison to the resistive voltage dividers described above, embodiments of the invention are not sensitive to the thickness or conductance of the first and second plate structures, or the thickness or conductance of the conductive members. Rather, in embodiments of the invention, the signals that are transmitted by the antenna member can depend on the overlapping areas of the first and second plate structures with a corresponding conductive member. In some embodiments, this overlapping area is substantially equal to the areas of the first and second plate structures. Unlike resistance-dependent printed resistors, which are affected by both by thickness and material conductance, the first and second plate structures, and the conductive members can be fabricated with high accuracy and in a cost-effective manner using standard printing and/or lithographic techniques. Accordingly, some embodiments of the invention can produce the same or better function as the resistive voltage dividers described above, while being less expensive to produce. For example, plate structures with small differences in areas can be produced without difficulty. Consequently, capacitors with small differences in capacitances can be produced. The small differences in capacitances can be used to produce many different signals over a two or three-dimensional surface. Accordingly, embodiments of the invention can have high resolution. In addition, since resistors need not be used to create voltage differences, the problems that are associated with forming resistors of uniform resistance (or of precise resistance) are not present in embodiments of the invention. Also, in embodiments of the invention, an EEPROM chip is not needed to store calibration data for resistors since resistors are not needed to produce different signals. This reduces the cost of the electrographic position location apparatus as compared to an electrographic position location apparatus with a resistive voltage divider. Lastly, in embodiments of the invention, expensive conductive materials need not be used, since variations in the resistances of resistors are not of concern in embodiments of the invention.

Referring again to FIG. 3(*a*), the dielectric layer 30 which forms the dielectric medium for the first and second capacitors may be in any suitable form, have any suitable thickness, and may be made of any suitable material. Suitable materials include insulating materials such as polyimide or polyethylene terepthalate (Mylar™). The dielectric layer 30 could be flexible or rigid, and transparent or non-transparent. Transparent dielectric layers are desirable since it is possible to easily determine if plate structures and a conductive member on opposite sides of a dielectric layers are properly aligned. Preferably, the dielectric layer 30 is a flexible layer such as a layer of Mylar™. The dielectric layer 30 may be in the form of a planar sheet, or may be in the form of a strip of dielectric material. For example, in some embodiments, the dielectric layer 30 may be a strip of material that has lateral dimensions closely conforming (e.g., within about 10%) to the lateral geometries of the first and second plate structures 24(*a*)–24(*c*), 26(*a*)–26(*c*) so that the antenna device as a whole may be in the form of a strip. The antenna device could also be in the form of a planar sheet.

The first and second conductors 16, 18 and the first and second plate structures 22(*a*)–22(*c*), 24(*a*)–24(*c*) may be made with any suitable material and may be made using any suitable process. Examples of materials include carbon or silver based inks, printed copper features, indium tin oxide, etc. The first and second conductors 16, 18 may be, for example, printed circuits. In some embodiments, the first and second plate structures 22(*a*)–22(*c*), 24(*a*)–24(*c*) may be predetermined portions of the first and second conductors 16, 18. For example, in such embodiments, the first and second conductors 16, 18 could be printed conductive lines with varying widths. The plate structures in the first and second conductors 16, 18 could be the portions of the printed conductive lines that are defined by the varying widths. The first and second conductors 16, 18 and the first and second plate structures 22(*a*)–22(*c*), 24(*a*)–24(*c*) could be formed using any suitable process including a screen printing process, a photolithography process, etc. As known to those of ordinary skill in the art, highly accurate and precise conductive patterns can be formed by such methods.

Although the conductive members 26(*a*)–26(*c*) and the plate structures 22(*a*)–22(*c*), 24(*a*)–24(*c*) are shown as being rectangular in shape, other shapes could be used in other embodiments of the invention. In other embodiments, the conductive members and/or the plate structures could be regular or irregular, and/or continuous or discontinuous. They can be rectangular, square, circular, polygonal, curved, linear, etc. For example, as explained in more detail below, a conductive member could have a plate structure, an elongated portion and radiating region in some embodiments. Also, as explained in more detail below, the plate structures 26(*a*)–26(*c*) could be spiral or comb-shaped in other embodiments of the invention.

FIG. 3(*c*) shows a simplified circuit diagram corresponding to the antenna device shown in FIG. 3(*a*). FIG. 3(*c*) shows a plurality of first capacitors 81(*a*)–81(*c*) and a plurality of second capacitors 83(*a*)–83(*c*). Each pair of first and second capacitors 81(*a*)–83(*a*), 81(*b*)–83(*b*), 81(*c*)–83(*c*) has a common plate. Each common plate forms at least part of a conductive member 26(*a*)–26(*c*) and each conductive member 26(*a*)–26(*c*) may transmit a different signal. As shown in FIG. 3(*c*), different input signals may be provided in first and second conductors 16, 18 using two different alternating voltage sources. In FIG. 3(*c*), the signals are +SIG, −SIG (e.g., sinusoidal signals at +3V and −3V with a fundamental frequency of about 8 kHz). The first and second capacitor pairs 81(*a*)–83(*a*), 81(*b*)–83(*b*), 81(*c*)–83(*c*) can cause the conductive members 26(*a*)–26(*c*) to produce different signals.

FIG. 3(*d*) shows a modification of the antenna device shown in FIG. 3(*a*). FIG. 3(*d*) shows a conductive grounding element 177 that is formed around the conductive members 26(*a*)–26(*c*). The conductive grounding element 177 can be connected to ground and can shield the conductive members 26(*a*)–26(*c*). Undesired signals in the vicinity of the conductive members 26(*a*)–26(*c*) can be removed using the grounding element. As shown, the conductive grounding element 177 can encircle one or more conductive members 26(*a*)–26(*c*).

FIG. 3(*d*) also shows that, with the exception of capacitive coupling, the conductive, members 26(*a*)–26(*c*) can be electrically isolated from the conductive grounding element 177 and other conductive structures in an electrographic position location apparatus.

Figure 4:
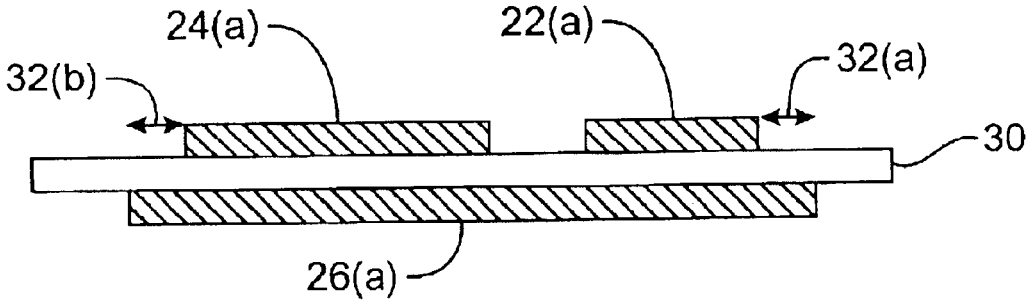
FIG. 4 shows a cross-sectional view of an antenna member with a first plate structure, a second plate structure, and a conductive member.

FIG. 4 shows a first plate structure 22(*a*) and a second plate structure 24(*a*) on one side of a dielectric layer 30. A portion of a conductive member 26(*a*) is on the other side of the dielectric layer 30. First and second capacitors may be formed by the first and second plate structures 22(*a*), 24(*a*), respectively. The conductive member 26(*a*) forms a structure that is common to the first and second plate structures 22(*a*), 24(*b*). The first capacitance formed by the first capacitor can depend on the area of the first plate structure 22(*a*). The second capacitance of the second capacitor can depend on the area of the second plate structure 24(*a*). For example, as shown in FIG. 5, the first and second capacitances of the first and second capacitors can depend on the patterned areas of the first and second plate structures 22(*a*), 24(*a*).

Figure 5:
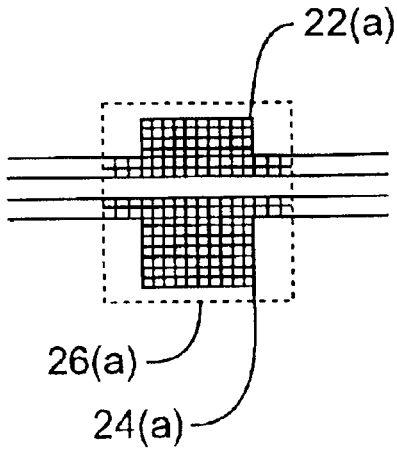
FIG. 5 shows a top view of the antenna member in FIG. 4 with the effective areas of a first capacitor and a second capacitor formed by a first plate structure and a second plate structure shown by a grid pattern.

As shown in FIGS. 4 and 5, in preferred embodiments, the planar dimensions of the conductive member 26(*a*) can be greater than the planar dimensions of the first plate structure 22(*a*) and the second plate structure 24(*a*). Referring to FIG. 4, the outer edges of portions of the first and second plate structures 22(*a*), 24(*a*) can be inside of the edges of the conductive member 26(*a*) by predetermined distances 32(*a*), 32(*b*). In some embodiments, a conductive member may have an area that is at least about 5 percent greater than the combined area of its corresponding first and second plate structures. For example, a third plate structure in a conductive member may overlap a first plate structure by a first overlap area and may overlap a second plate structure by a second overlap area. The total of the first overlap area and the second overlap area, added together, may be less than the area of the third plate structure of the conductive member. By making the effective portion of the conductive member 26(*a*) larger than its corresponding first and second plate structures 22(*a*), 24(*a*), a larger tolerance is provided in the event that the printed conductive member 26(*a*) is misaligned with the first and second plate structures 22(*a*), 24(*a*). For example, referring to FIG. 5, the first and second plate structures 22(*a*), 24(*a*) could be shifted and slightly misaligned to the left or right with respect to the conductive member 26(*a*). The areas of the first and second plate structures 22(*a*), 24(*a*) that overlap with the conductive member 26(*a*) would still be about the same despite any potential misalignment. Accordingly, by making the pertinent portion of the conductive member larger than the combined area of the first and second plate structures, a greater degree of misalignment between images on opposite sides of the dielectric layer 30 could be tolerated. This can result in lower manufacturing costs since highly accurate alignment steps are not needed in embodiments of the invention.

Figure 6:
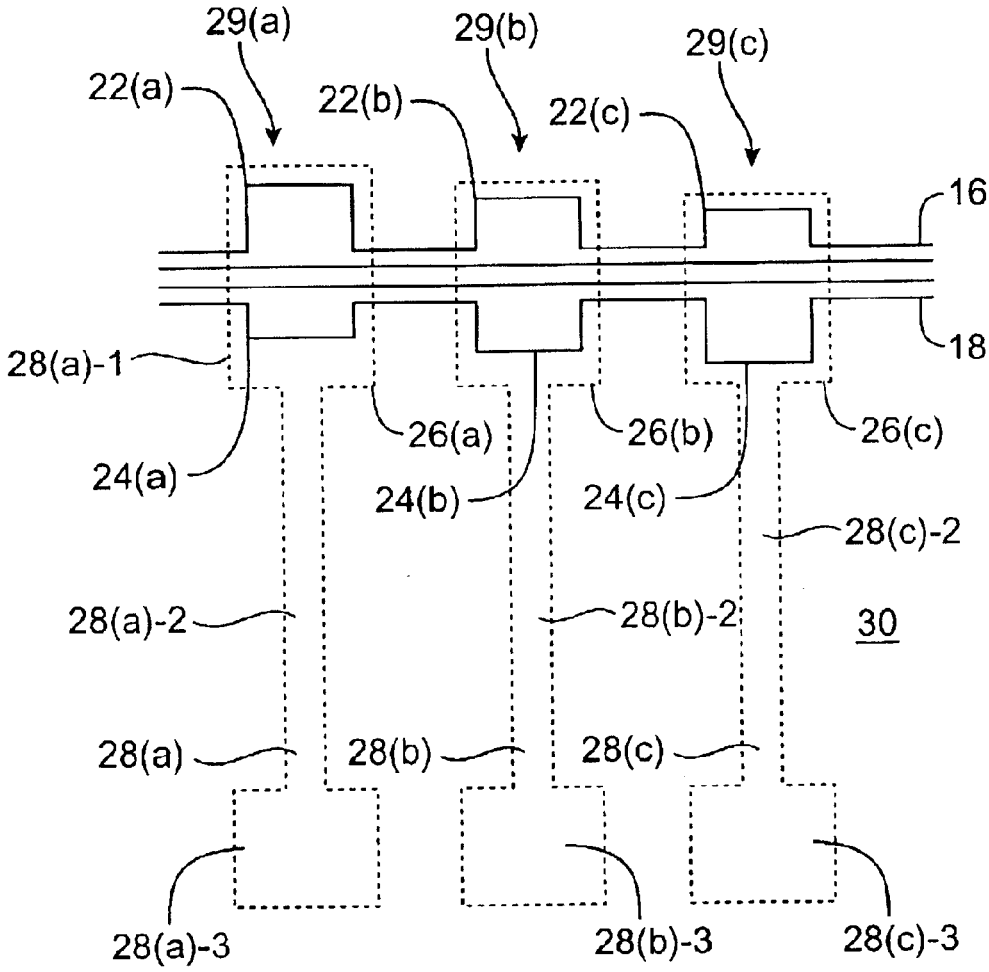
FIGS. 6 and 7 show top views other antenna device embodiments.

FIG. 6 shows another antenna device according to an embodiment of the invention. Like the embodiment shown in FIG. 3(*a*), the antenna device includes a first conductor 16 having a plurality of first plate structures 22(*a*)–22(*c*) and a second conductor 18 having a corresponding plurality of second plate structures 24(*a*)–24(*c*). However, in this embodiment, the conductive members 28(*a*)–28(*c*) associated with the pairs of first and second plate structures 22(*a*)–24(*a*), 22(*b*)–24(*b*), 22(*c*)–24(*c*) are shaped differently than the conductive members shown in FIG. 3(*a*).

In FIG. 6, each conductive member 28(*a*)–28(*c*) includes a third plate structure 28(*a*)-1, 28(*b*)-1, 28(*c*)-1, an elongated portion 28(*a*)-2, 28(*b*)-2, 28(*c*)-2, and a widened radiating portion 28(*a*)-3, 28(*b*)-3, 28(*c*)-3. The widened radiating portions 28(*a*)-3, 28(*b*)-3, 28(*c*)-3 can transmit strong signals since the transmitting areas provided by them are wide. The narrower elongated portions 28(*a*)-2, 28(*b*)-2, 28(*c*)-2 can be narrower to decrease the likelihood of coupling between adjacent conductive members 28(*a*), 28(*b*), 28(*c*). Other embodiments of the invention are also possible. For example, the wider radiating portions 28(*a*)-3, 28(*b*)-3, 28(*c*)-3 could be omitted in some embodiments so that only the elongated portions 28(*a*)-2, 28(*b*)-2, 28(*c*)-2 and the third plate structures 28(*a*)-1, 28(*a*)-2, 28(*a*)-3 are present. Also, although elongated portions 28(*a*)-2, 28(*b*)-2, 28(*c*)-2 are illustrated as being linear, non-linear elongated portions (e.g., curved, zig-zagged) could be used in other embodiments.

Figure 7:
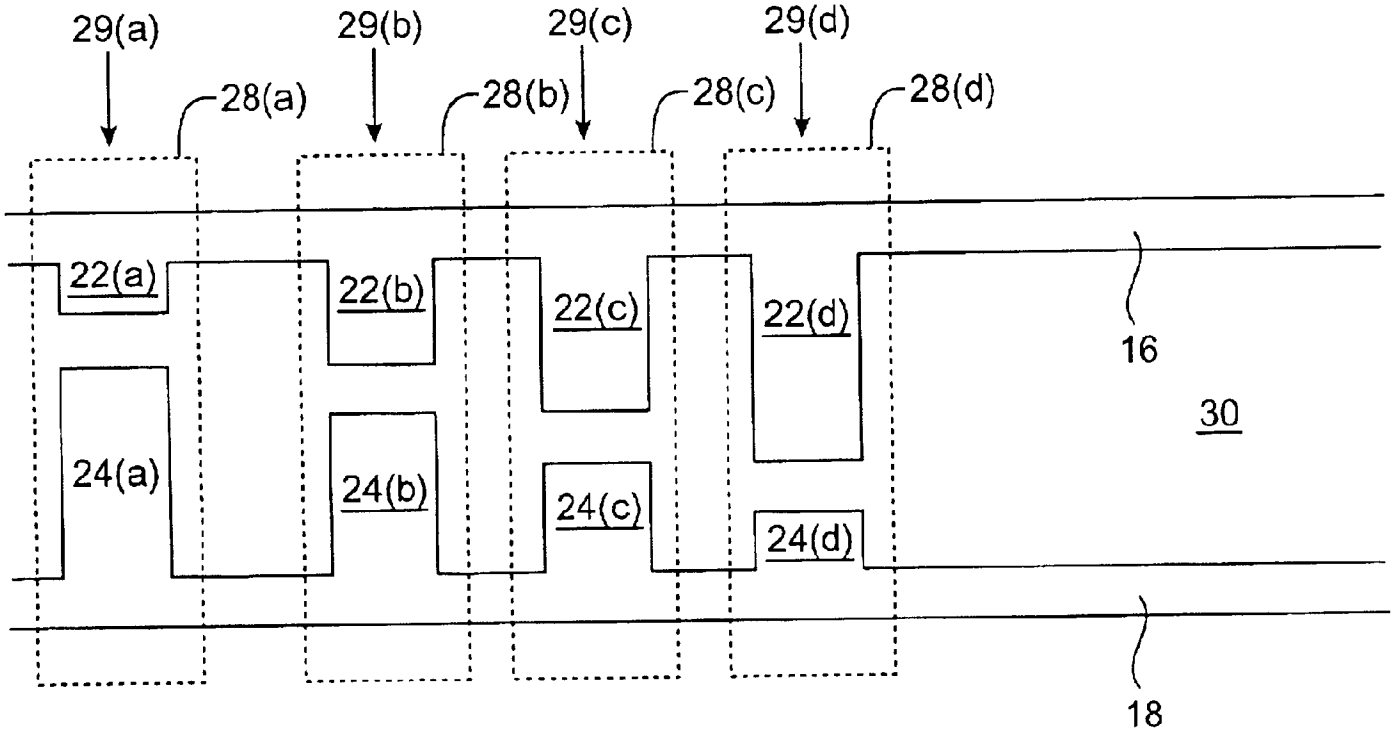

FIG. 7 shows another antenna device embodiment. In this embodiment, the first and second plate structures 22(*a*)–22(*d*), 24(*a*)–24(*d*) of the first and second conductors 16, 18 face inwardly toward each other. As in previously described embodiments, antenna members 29(*a*)–29(*d*) can be formed from pairs of first and second plate structures 22(*a*)–24(*a*), 22(*b*)–24(*b*), 22(*c*)–24(*c*), 22(*d*)–24(*d*) and corresponding conductive members 28(*a*)–28(*d*). As shown in FIG. 7, the first and second plate structures can have different areas.

Figure 8:
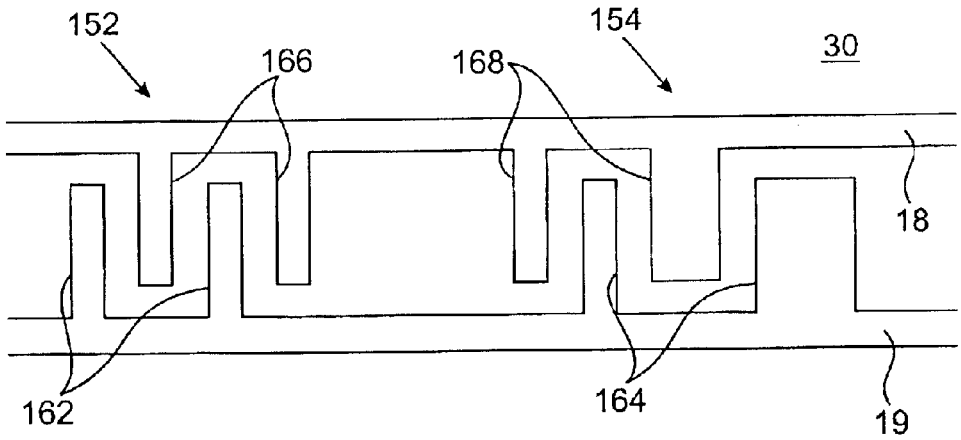
FIG. 8 shows a top view of another antenna device embodiment. In this embodiment, no conductive member is present.

FIG. 8 shows an antenna device embodiment with an antenna member that does not have a conductive member. FIG. 8 shows an antenna device with first and second conductors 18, 19. Alternating voltage sources may be coupled to the first and second conductors 18, 19. The first and second conductors 18, 19 include a first antenna member 152 and a second antenna member 154. In FIG. 8, only two antenna members are shown for purposes of illustration and it is understood that more than 3, 4, 5, etc. antenna members may be included in an antenna device according to embodiments of the invention. The first conductor 18 includes a plurality of first plate structures 166, 168 and the second conductor 19 includes a plurality of second plate structures 162, 164. Both the first and second conductors 18, 19 are on a dielectric layer 30. The first plate structures 166, 168 are each shaped as a comb structure and have different areas. Likewise, the second plate structures 162, 164 have different areas and are shaped like comb structures. As shown in FIG. 8, the comb structures of the first plate structures 166, 168 are cooperatively structured with respect to the comb structures of the second plate structures 162, 164.

By forming first and second plate structures that are cooperatively structured with respect to each other, signals that are transmitted from pairs of cooperatively structured first and second plate structures can combine to form a unique signal that is indicative of the location of the transmitting pair of first and second plate structures. Accordingly, in this embodiment, the transmitted signals need not be collected in a conductive member. Rather, the transmitted signals will be sufficiently integrated so that a unique signal is produced without the aid of conductive members. Of course, embodiments of the invention are not limited thereto. For example, in some embodiments, conductive members could be under the pairs of first and second plate structures 162, 164, 166, 168 shown in FIG. 8.

A pair of first and second plate structures in an antenna member may be cooperatively structured with respect to each other. For example, the first and second plate structures shown in FIG. 8 are in the form of combs with linear fingers. The combs face each other so that the fingers are interleaved. In other embodiments, comb-like structures could be used, but the fingers of the comb-like structure could be curved instead of liner. In yet other embodiments, it is possible to have first and second conductors with first and second plate structures that spiral toward a central point. In this embodiment, the first and second plate structures are sufficiently interleaved with respect to each other so that a unique signal is produced. In this embodiment, many such spirals could be created. A first plate structure in the form of a spiral could have a different area than the areas of other plate structures in other spirals. In addition, a second plate structure in the form of a spiral could have a different area than the areas of other plate structures in other spirals.

Figure 9:
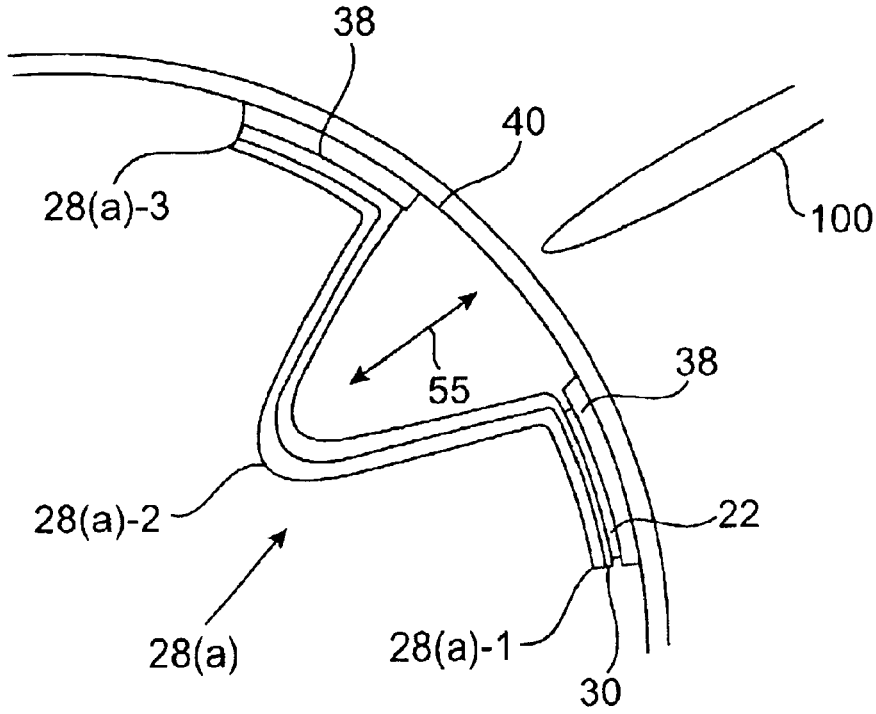
FIG. 9 shows an antenna member attached to an inner surface of a housing.

FIG. 9 illustrates how an antenna device according to an embodiment of the invention can be secured to a three-dimensional housing. As shown in FIG. 9, a widened portion 28(*a*)-3 of an antenna element can be attached to a first region of the inside surface of a housing 40 using an adhesive 38. The third plate structure 28(*a*)-1 and a first plate structure 22 can be attached to a second region of the inside surface of the housing 40 using an adhesive 38. As in prior embodiments, a dielectric layer 30 may be between the first plate structure 22 and the third plate structure 28(*a*)-1. The elongated portion 28(*a*)-2 of the conductive member 28(*a*) is spaced from the inner surface of the housing 40 so that when a stylus 100 is near the outer surface of the housing 40, it does not pick up any signals being transmitted by the elongated portion 28(*a*)-2. This makes the widened radiating portion 28(*a*)-3 a "hot spot" on the housing 40 that is rendered selectable while other portions of the housing 40 are not selectable or provide a different output than the region over radiating portion 28(*a*)-3

Illustratively, an image (e.g., an image of the United States) could be printed on the outer surface of the housing 40 over the widened portion 28(*a*)-3, but not over the elongated portion 28(*a*)-2 or the third plate structure 28(*a*)-1. When the stylus 100 is used to select the image that is over the widened portion 28(*a*)-3, the stylus 100 receives the signal being transmitted by the widened portion 28(*a*)-3. An output that relates to the image can then be presented to the user. For example, the phrase "the United States, population, 230 million" could be presented to the user. If the stylus 100 is placed over the elongated portion 28(*a*)-2 or the third plate structure 28(*a*)-1, no output or a different output than an output associated with the "United States" would be produced.

FIG. 9 illustrates that, in embodiments of the invention, it is possible to pre-form an antenna device and then selectively attach portions of it to a housing. The antenna device may be coated with an adhesive material and then may be adhered to the inner surface of the housing of an electrographic position location apparatus. The housing may include a printed image on its exterior surface. An appropriate portion of an antenna device according to an embodiment of the invention may be adhered to the interior surface of the housing on the side opposite to the printed image. In this way, an electrographic position location apparatus may be fabricated inexpensively, quickly, and efficiently. Also, it is possible to fabricate an electrographic position location apparatus with as many "hot spots" as desired. For example, fewer "hot spots" can be created in the apparatus, thus reducing material costs. Thus, it is possible to manufacture an electrographic position location apparatus according to an embodiment of the invention with any number of hot spots cost efficiently.

There are other ways of attaching an antenna device to a three-dimensional housing. For example, in a housing for a globe, it is possible to have the antenna device lie flat along the inner surface of the housing. In this approach, it is possible to control or create the hot spot active area by designing the conductive member to be the desired size and shape of the hot spot. Areas outside the desired hot spot have a topside ground shield so that the conductive member is the only transmitting element and thus determines the hot spot area. For example, with reference to FIG. 9, a ground shield (or grounding element) could be between the elongated portion 28(*a*)-2 and the housing 40 and also the first plate structure 22 and the housing 40, but not between the widened portion 28(*a*)-3 and the housing 40. The result of this is that the widened portion 28(*a*)-3 will be the only portion of the conductive member 28(*a*) that transmits a unique signal outside of the housing 40.

In embodiments of the invention, two different functional approaches can be described. Each approach can use specific algorithms, and each approach can be used in conjunction with a two-dimensional or three-dimensional surface (of a housing). The first approach can be referred to as a "single coordinate antenna" approach. Examples of the single coordinate antenna approach are described above (e.g., in FIGS. 3(*a*) and 6). In this approach, a single coordinate antenna device (e.g., comprising first and second plates and optional conductive members, etc,) together with drive electronics and associated algorithms are used to detect the position of a stylus. As described, the single coordinate antenna device can be used to create specific "hot spot" active areas. The hot spot areas can be distributed in any arrangement under a two- or three-dimensional surface. Coordinates values (representing locations) can be distributed in any arrangement under a two- or three-dimensional surface.

Multiple single coordinate antenna devices can be used to create more active spots and/or cover a larger surface area. In the case of multiple single coordinate antenna devices, each antenna device can operate individually with respect to the other antenna devices, usually in a serial approach (i.e., activating one antenna device at a time). For example, in an interactive globe, 8 individual single coordinate antenna devices can be used. Each antenna device may operate independently of the other antenna devices.

In the single coordinate antenna approach, single coordinate antenna devices can be configured with active areas being located adjacent to one another in close proximity such that the transmitted fields merge and create intermediate values. In this case, a field gradient is created above the active areas (which could correspond to the locations of the conductive fingers) and thus allows for the measurement of intermediate, or continuous location values. When a single coordinate antenna device is used in this manner, a "line" of position is determined which follows the adjacent located active areas. The line may or may not be straight.

A second approach may be referred to as a "dual coordinate antenna" approach. In this approach, two (or more) antenna devices are used in cooperation to determine location in a two (or more) coordinate system. Separate drivers may be used to drive the different antenna devices. Portions of two (or more) different antenna devices may overlap each other. Together, they can be used to determine the position that is selected by a user. The dual coordinate antenna approach can be used when it is desirable to activate a surface at every location within an active area, as opposed to just specific hot spots or a line of activation. In the dual coordinate antenna approach, transmitting fingers are typically used. These transmitting fingers are part of a first antenna device and form a continuous field gradient which allows for continuous location measurement (as opposed to discrete spots). Additionally, a second antenna device, usually positioned to generate an orthogonal field gradient, is used to create a measurement along an orthogonal coordinate axis. The conductive fingers in the first and the second antenna devices can be orthogonal to each other. Thus, the position of a receiving stylus can be determined by its measured location in a coordinate domain. The dual coordinate antenna approach can also be used with a two-dimensional surface (such as a book pad) or a three-dimensional surface such as a globe.

Figure 10A:
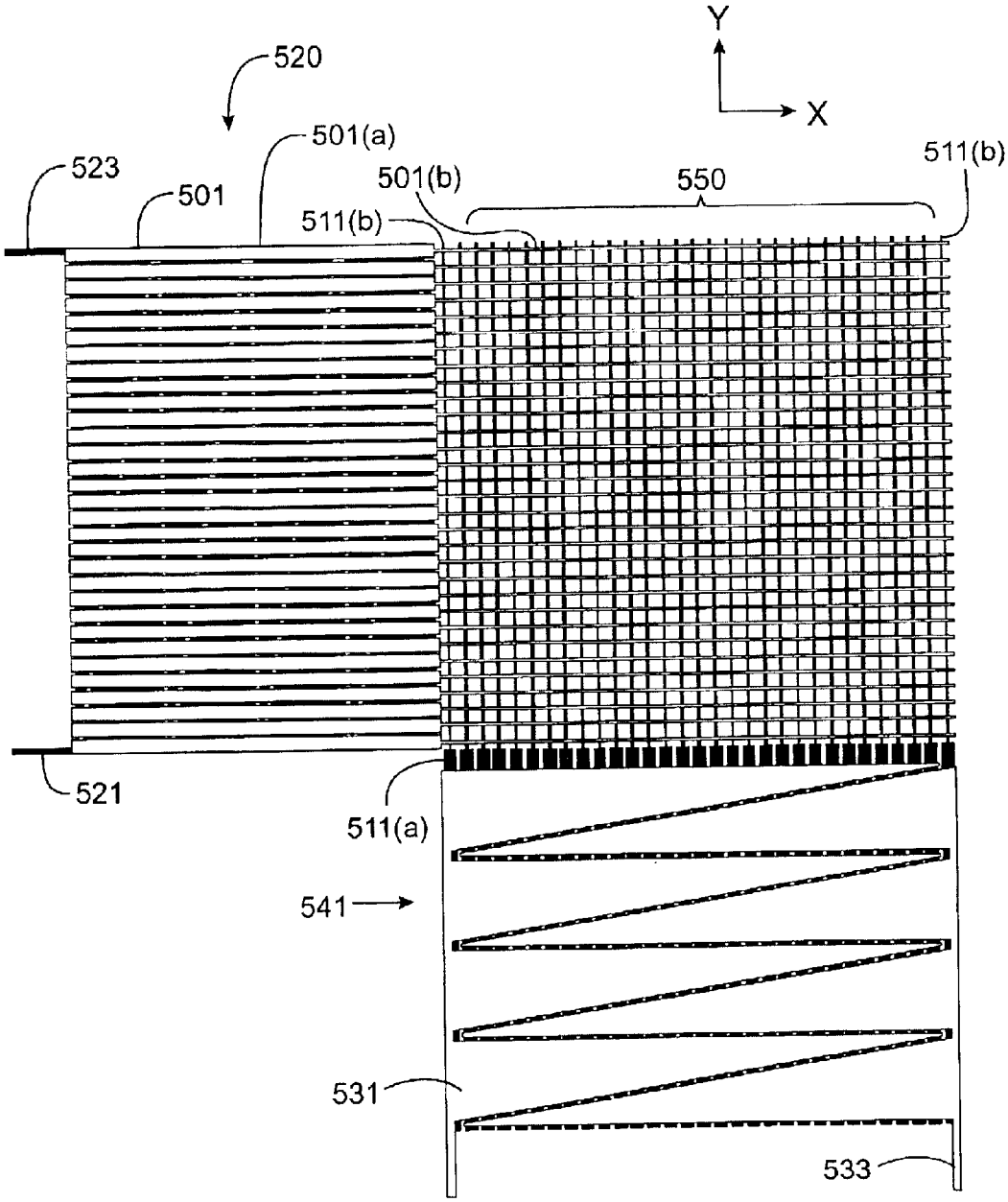
FIG. 10(*a*) shows a top view of a portion of two-dimensional antenna devices.
Figure 10B:
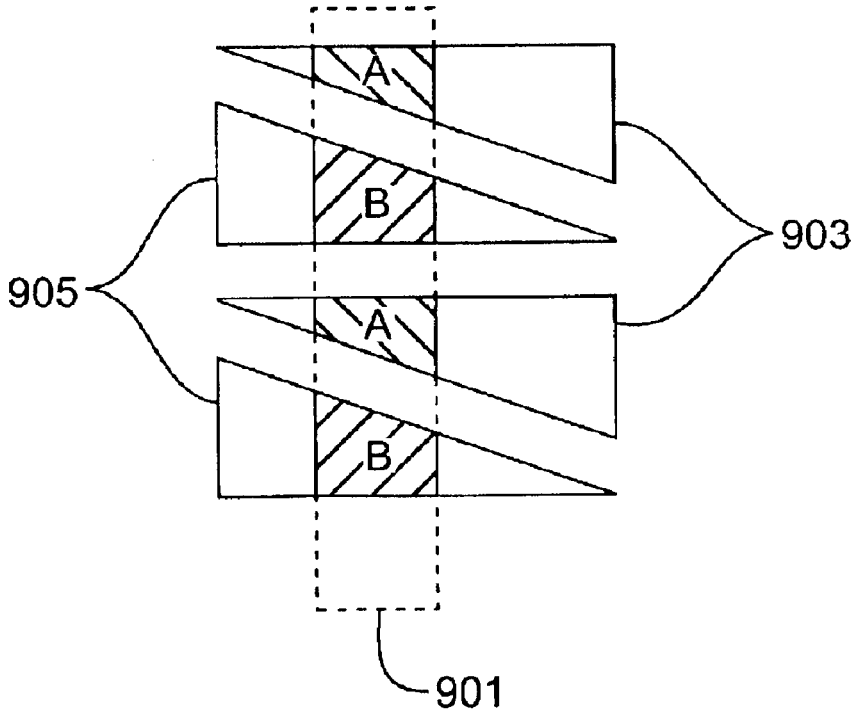

FIG. 10(*a*) shows an embodiment that follows the dual coordinate antenna approach. FIG. 10(*a*) shows an illustration of an X-Y grid that can be used under a two-dimensional or three-dimensional surface of a housing. The X-Y grid shown in FIG. 10(*a*) can be under a planar surface of a housing and can provide a substantially continuous gradient of equipotential lines over an active surface.

Referring to FIG. 10(*a*), a first antenna device 520 has generally linear conductive members 501. The conductive members 501 are oriented in an x-direction. The conductive members 501 are on top of a dielectric layer and have third plate structures 501(*a*) and fingers 501(*b*). A first conductor 521 with four triangle-shaped conductive structures are under the dielectric layer and overlap the third plate structures 501(*a*). A second conductor 523 with, for example, four triangle-shaped conductive structures is also under the dielectric layer. In other embodiments, there could be one triangle-shaped conductive structure instead of four. However, in this example, the four triangle-shaped conductive structures of the second conductor 523 are cooperatively configured with the four triangle-shaped conductive structures of the first conductor 521. In this embodiment, each triangle-shaped conductive structure overlaps more than one conductive member. Also, more than one conductive structure may overlap a single conductive member in a single antenna element. In the illustrated embodiment, the conductive members 501, 511 are oriented generally perpendicular to the orientation of the triangular-shaped conductive structures.

A second antenna device 541 also has generally linear conductive members 501. The conductive members 511 are oriented in a y-direction. The conductive members 501 are under the dielectric layer and have third plate structures 511(*a*) and fingers 511(*b*). A first conductor 531 with four triangular conductive structures is under the dielectric layer and overlaps the third plate structures 511(*a*) of the conductive member 511. A second conductor 533 with four triangular conductive structures is also under the dielectric layer. The four triangular conductive structures of the second conductor 533 are cooperatively structured with the four triangular conductive structures of the first conductor 531.

In the example shown in FIG. 10(*a*), a first plate structure (or a second plate structure) corresponding to a particular conductive member may be the portions of the triangular conductive structures that overlie that conductive member. Thus, the first plate structure may include portions of triangular structures, and these portions may be discontinuous with respect to each other. This is more clearly illustrated in FIG. 10(*b*) where triangular conductive structures 903 overlap a conductive member 901. The two portions labeled A may constitute a first plate structure in embodiments of the invention. Likewise, triangular structures 905 may overlap the conductive member 901, and the portions labeled B may constitute a second plate structure associated with the conductive member 901. Also, as illustrated in FIG. 10(*a*), portions of a first plate structure (or a second plate structure) may form part of one or more larger triangular conductive structures. Accordingly, in embodiments of the invention, one conductive structure (e.g., a triangular conductive structure) may form at least a portion of one or more first plate structures (or second plate structures).

Referring to FIG. 10(*a*), the fingers 501(*b*) of the x-oriented conductive members 501 and the fingers 511(*b*) of the y-oriented conductive members 511 are generally perpendicular with respect to each other and together form a grid. This grid can be an active area 550 of an apparatus that uses the two antenna devices. Although the area occupied by the third plate structures 501(*a*) of the conductive members 501 is shown as being slightly less than the active area formed by the fingers 501(*b*), 511(*b*), it is understood that such dimensions are for ease of illustration. In embodiments of the invention, the active area may be smaller or larger than the area occupied by the third plate structures of the conductive members.

Different signals can be transmitted from the fingers 501(*b*), 511(*b*) of the different conductive members 501, 531. When a stylus (not shown) is placed over a pair of crossing fingers 501(*b*), 511(*b*), unique signals transmitted from those fingers 501(*b*), 511(*b*) can be received by the stylus. In the case of this dual coordinate antenna approach, continuous fields generated by each orthogonal antenna are measured to resolve a position in a two-coordinate system. After receiving the unique signals, a microprocessor operatively coupled to the stylus can determine the x-y coordinates of the stylus and an output appropriate for the region selected by the stylus can be provided.

Unique signals can be produced using the triangular conductive structures associated with the first and second conductors 521, 523, 531, 533. For example, referring to FIG. 10(*a*), each third plate structure 501(*a*) in the first antenna device 520 has substantially the same area. The triangular conductive structures of the first conductor 521 overlap each third plate structure 501(*a*) of each conductive member 501 by a different amount. Also, the conductive structures of the second conductor 523 overlap each third plate structure 501(*a*) of each conductive member 501 by a different amount. Thus, like the previously described embodiments, for each conductive member 501, a first capacitor and a second capacitor is formed using a common third plate structure 501(*a*) of the conductive member 501. As a result, each conductive member 501 can have a different signal associated with it and these signals can be transmitted by the fingers 501(*b*) of the conductive members 501. A receiving antenna in a stylus can receive the transmitted signals.

In some embodiments, the first and second antenna devices 520, 541 can be formed using the same dielectric layer. For example, the conductive members 501 of the first antenna device 520 and the first and second conductors 531, 533 of the second antenna device 541 can be formed on one side of a dielectric layer. The conductive members 511 of the second antenna device 541 and the first and second conductors 521, 523 of the first antenna device 520 can be formed on the other one side of the dielectric layer. Alternatively, the first and second antenna devices 520, 541 could be formed on separate dielectric layers. In this alternative embodiment, the first and second antenna devices 520, 541 could be separately formed and then assembled together in a final apparatus that uses the antenna devices 520, 541.

Various modifications to the embodiment shown in FIG. 10(*a*) are possible. For example, although the fingers 501(*b*), 511(*b*) are shown as being substantially linear, they could be curved, wavy, or zig-zagged in other embodiments. Also, although the fingers 501(*a*), 511(*b*) are shown as being substantially uniform in width, it is possible to design the fingers 511(*b*) with widened wing portions. These wing portions can be wider areas of conductive material that are present between adjacent fingers 501(*b*) of the top conductive members 501. In some embodiments, the conductive members 501 on top may shield signals transmitted from the fingers 511(*b*) under them. The widened wing portions can transmit strong signals through the fingers 501(*b*) of the conductive members 501 on top. Wing portions are described in further detail in U.S. patent application Ser. No. 09/574,499, filed May 19, 2000, which is herein incorporated by reference for all purposes. In yet other embodiments, the triangular conductive structures shown in FIG. 8 could be of some other shape. For example, the plate structures may be irregularly shaped, curved, etc.

Figure 11:
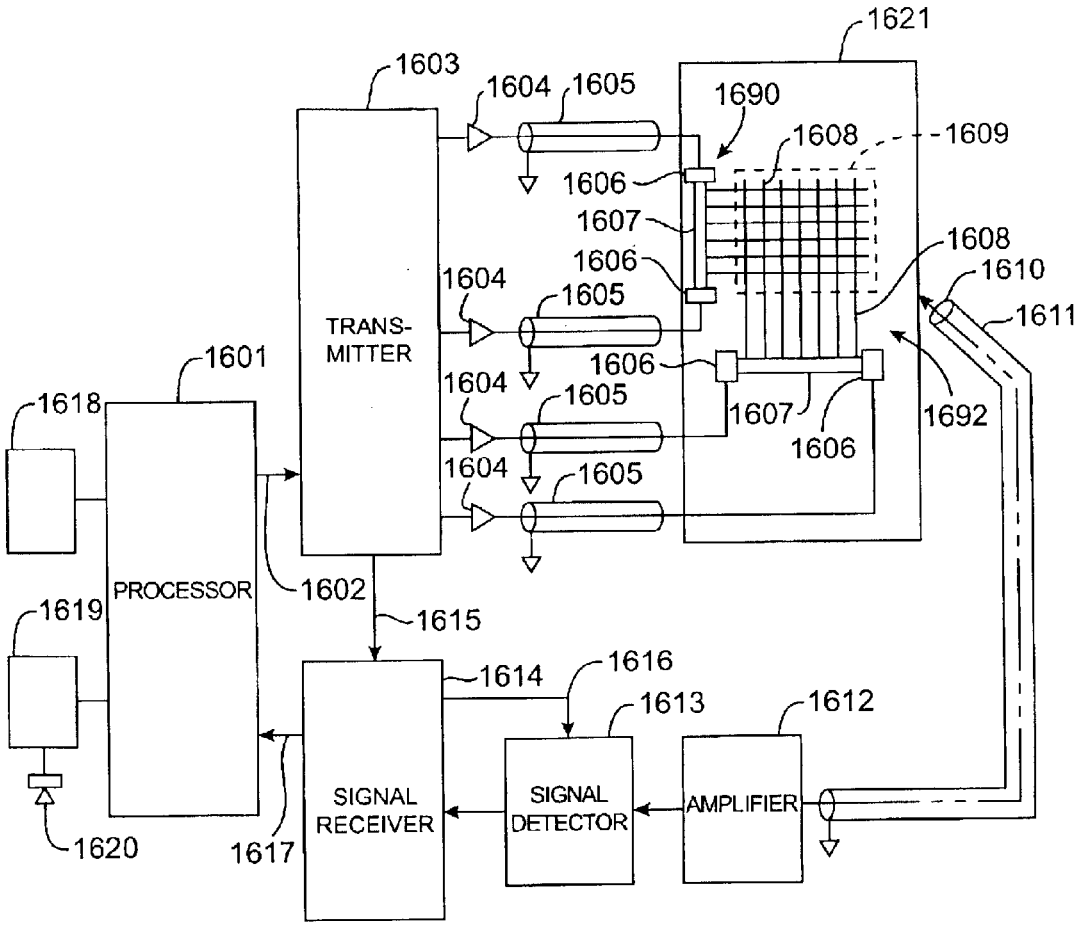
FIG. 11 shows a block diagram of an apparatus according to an embodiment of the invention.

FIG. 11 is a block diagram of a system that can use the antenna devices according to embodiments of the invention. The system in FIG. 11 could be used with a three or two-dimensional apparatus. When a single coordinate antenna approach is used, only one of the shown transmitting pair of antenna devices is incorporated. The system shown in FIG. 11 includes a processor 1601, preferably a microprocessor, which regulates the operation of an apparatus 1621 including the antenna devices 1690, 1692. The processor 1601 receives position data 1617, which it uses to determine the position of a stylus 1611 near the active area 1609 proximate to the finger elements of apparatus 1621. Processor 1601 also includes a user interface 1618 and an audio block 1619 for outputting an audio output via a speaker 1620.

The processor 1601 sends commands 1602 to transmitting logic block 1603 to cause a sequence of transmitting signals to perform a position detection function. The commands 1602 may include beginning and/or stopping position sensing. Additionally the commands 1602 may also be in regards to the desired resolution, i.e., commands 1602 may also include instruct transmitting block 1603 to adjust the mode of operation to achieve a desired resolution or speed for a particular application. Transmitting block 1603 may drive the two antenna devices 1690, 1692 of the electrographic position location apparatus according to predetermined multi-state drive sequence.

In some embodiments of a dual coordinate antenna system, a Five State Drive Algorithm is preferably used to determine the position a stylus (having a receiving antenna) over the pair of transmitting antenna devices. The algorithm can sequence through five states. Measurements can be manipulated at each state to obtain the location of the stylus. Illustratively, a stylus including a receiving antenna is used to point to a region overlying the transmitting antenna device pair. The receiving antenna in the stylus detects the magnitude of the electric field strength. The detected signals are transmitted to a microprocessor. In an exemplary embodiment, the five states that are measured by the receiving antenna can be: 1. no voltage is applied to either antenna device; 2. a gradient AC voltage is applied to only the top antenna device; 3. a constant magnitude AC voltage is applied to only the top antenna device; 4. a gradient AC voltage is applied to only the bottom antenna device; and 5. a constant AC voltage is applied to only the bottom antenna device. Constant AC voltages can be applied to the antenna device by, for example, applying the same signal to both a plurality of first plate structures and a plurality of second plate structures. A gradient of AC voltages can be applied to an antenna device by, for example, applying one signal to a plurality of first plate structures and a second different signal to a plurality of second plate structures. The signals may differ in any suitable manner (e.g., by phase, magnitude, etc.).

Following the above-described 5 state sequence, first, the potential measured by the stylus during state 1 is subtracted from each of the other four measurements to remove any DC error component. After the subtraction, there are four measured field potential values: $P_{Top\text{-}G}$; $P_{Top\text{-}C}$; $P_{Bottom\text{-}G}$; and $P_{Bottom\text{-}C}$, respectively, where "G" refers to application of a gradient voltage to the antenna device and "C" refers to application of a constant voltage to the antenna device. Second, to remove any variation attributable to the receiving antenna possibly being at different heights with respect to the underlying broadcasting antenna device pair, each gradient measurement is normalized to the constant voltage measurement for both the top and bottom antenna device. Thus, for the top antenna device a value is obtained for the ratio $P_{Top\text{-}G}/P_{Top\text{-}C}=P_{Top}$ and for the bottom antenna a value is obtained for the ratio $P_{Bottom\text{-}G}/P_{Bottom\text{-}C}=P_{Bottom}$. Last, the positional meaning of each of the two values, $P_{Top}$ and $P_{Bottom}$ is determined in terms of physical coordinates through use of an algorithm based on the designed equipotential line distribution.

The algorithm described above can be used in a dual coordinate antenna approach. In the case of a single coordinate antenna approach, a three-state algorithm can be used: 1. no voltage is applied to either a first conductor or second conductor (with corresponding plate structures); 2. a constant AC voltage (e.g., a second voltage) is applied to both the first and second conductor; and 3. a gradient AC voltage (e.g., a third voltage) is applied to the first and second conductors. First, a first potential measured by the stylus at state 1 is subtracted from each of the potential measurements in state 2. (i.e., a second potential) and state 3. (i.e., a third potential) to create potentials $P_C$ and $P_G$. Then, the potential P for a measured position can be determined by the following equation: $P=P_G/P_C$. If multiple, single coordinate antenna devices are used, then each antenna device can be activated individually with a 3 state algorithm such as this. In an alternate approach, it is possible to first activate each antenna device individually with a constant AC voltage in order to determine which antenna the stylus is near. After determining which antenna is coupled to the stylus, then the 3 state algorithm described can be used on only that antenna device. This latter approach can be faster than constantly activating all antennas with 3 states.

It is understood that, in embodiments of the invention, the above described 3- or 5-state algorithms can be embodied by computer code in any suitable computer readable medium including, for example, a memory chip or a disk drive. The computer readable medium can be used in an electrographic position location apparatus in conjunction with a processor to determine a particular position that is selected by the user.

Referring to FIG. 11, the drive signals of transmitting logic block 1603 are preferably amplified with amplifiers 1604 and transmitted via wires having wire shielding 1605. Each antenna device 1690, 1692 has two electrical contacts 1606 driving a strip 1607 with plate structures.

Stylus 1610 has a conductive element, which receives the transmitted signals. A conductor with a ground shield 1611 passes the received signals to a receiving amplifier 1612. The receiving amplifier 1612 may perform any conventional gain, filtering, and DC rejection function to amplify and condition the received signals. The conditioned signals are sent to signal detection block 1613, which performs demodulation, and analog to digital conversion. The signals may be optionally integrated. In a preferred embodiment synchronous demodulation of a single frequency signal is used because this enhances the signal to noise ratio. Synchronous demodulation uses timing signals 1615 and 1616 to coordinate the activities of signal detection block 1613. In a preferred embodiment, signal detection block 1613 integrates the signal to achieve narrow band filtering and uses a constant slope discharge technique to convert the integrated signal to a digital value for interpretation by the receive logic block 1614. The receive logic block 1614 directs the received signal detection process with receive timing signals 1616. For the case where synchronous demodulation is used, transmit timing information 1615 is included with the receive timing signals 1616. The receive logic block 1614 accepts digital data from the receive signal detection block 1613 and formats the data as appropriate for delivery to controller 1601.

The antenna devices and the electrographic position location apparatuses according to embodiments of the invention can be used in any suitable application where the detection of a particular position over a surface is desirable. For example, they may be used in a graphics tablet device, a reading device, an educational toy, an input screen for a kiosk, an interactive globe, an interactive toy doll (plush or hard), an interactive learning device, etc.

Figure 12:
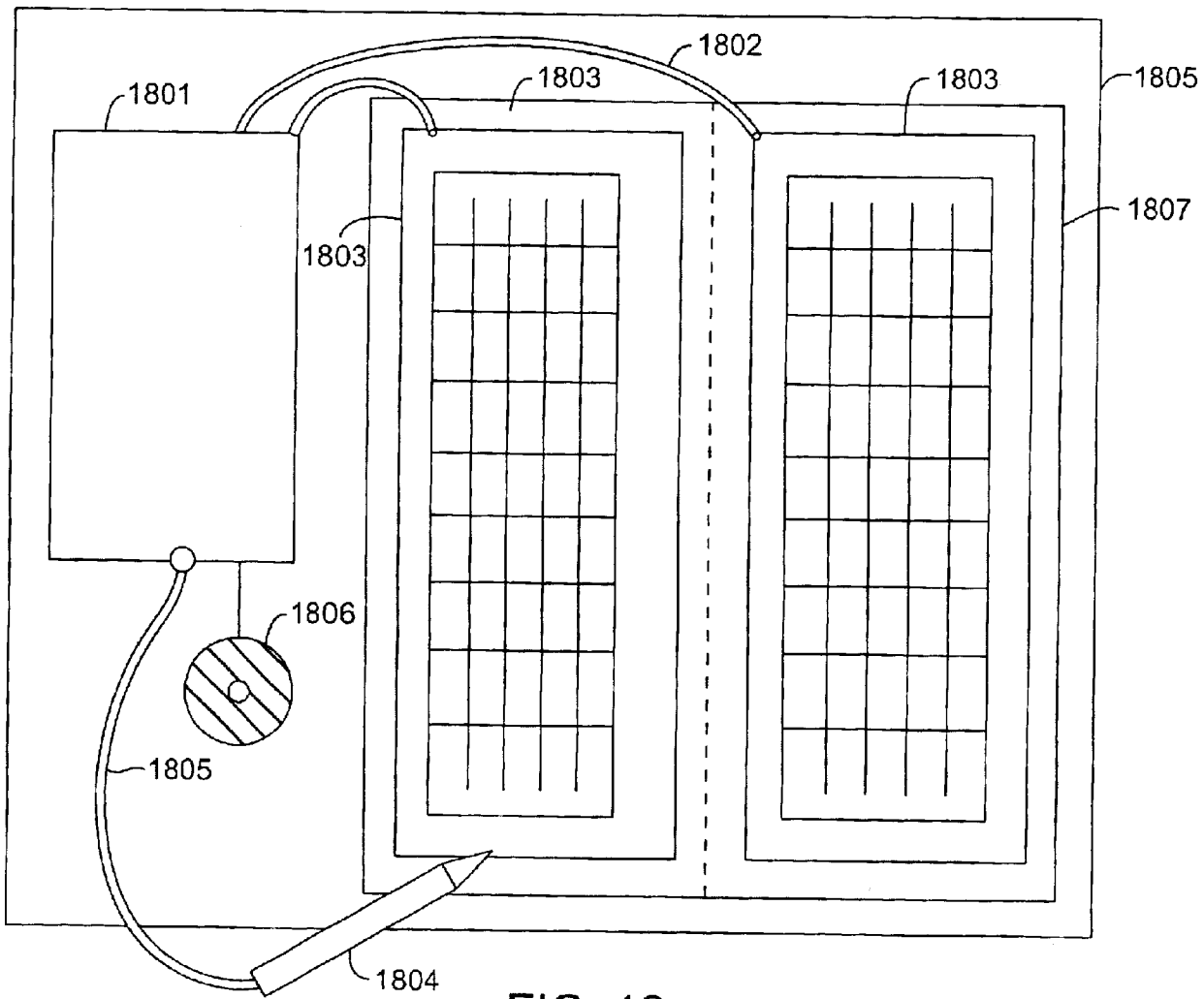
FIG. 12 shows a schematic illustration of an apparatus having a two-dimensional housing that houses a two-dimensional antenna device.

The antenna devices according to embodiments of the present invention can be used to create interactive talking book devices. As shown in FIG. 12, the sheets of a booklet 1807 are over an active surface having at least one antenna apparatus 1803 with at least one antenna device. A stylus 1804 points at a portion of an open page of booklet 1807 to identify a word, letter, or picture. A microprocessor 1801 then calculates the position of stylus 1804 relative to antenna apparatus 1803. A speaker 1806 provides an audio output as a function of the portion of booklet 1807 to which the user pointed stylus 1804.

In a preferred embodiment, the antenna device embodiments are used to detect the position of a stylus over a platform. A receiving antenna is located in the stylus. Exemplary structural features of the platform are in a patent application entitled "Print Media Receiving Unit Including Platform and Print Media", U.S. Patent Application Ser. No. 09/777,262, filed Feb. 5, 2001. This U.S. patent application is herein incorporated by reference in its entirety.

Figure 13:
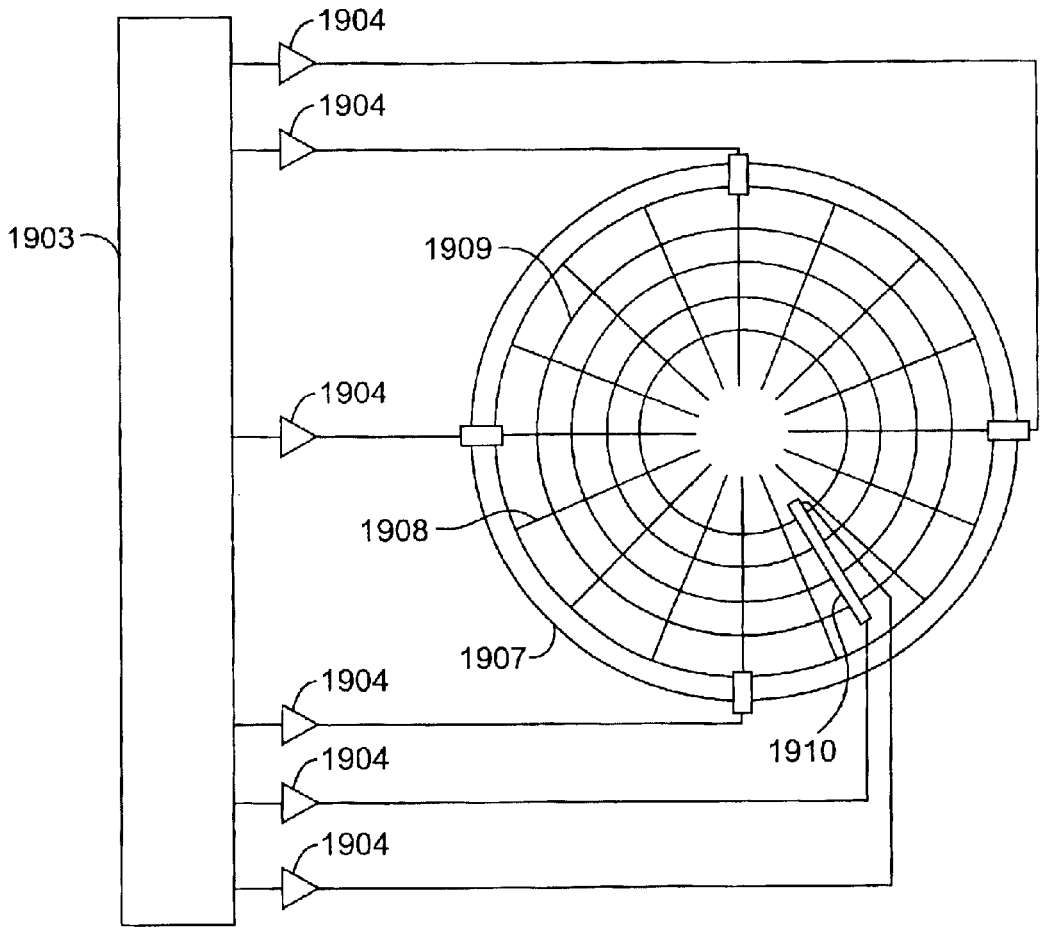
FIGS. 13 and 14 show schematic illustrations of apparatuses including a three-dimensional housing that houses an antenna device.

FIG. 13 is a schematic block diagram of a position sensing system with a hemispherical dual coordinate antenna system having a first antenna device with radial finger elements 1908 coupled to a strip 1907 with plate structures and conductive members and a second antenna device comprised of circular-shaped finger elements 1909 coupled to a radially, or longitudinally, oriented strip 1910 with plate structures and conductive members. Transmitting block 1903 and amplifiers 1904 are arranged to provide the drive signals to the antenna devices.

Figure 14:
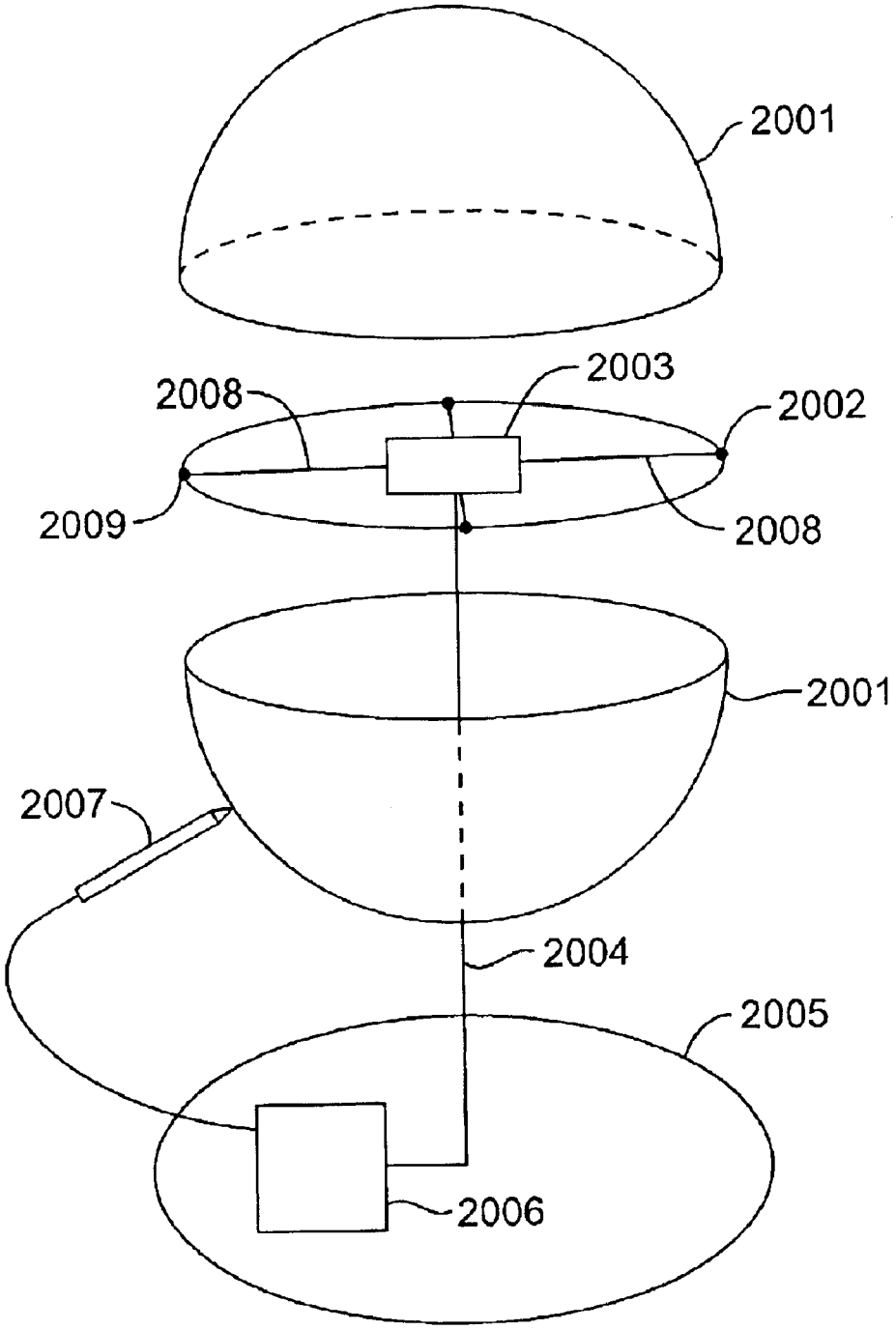

FIG. 14 shows an exploded perspective view of a globe having an antenna apparatus shaped as two hemispheres 2001, a plastic disk 2002 which supports a transmitting logic block 2003. Electrical contact wires 2008 couple transmitting logic block 2003 to electrical clips 2009. Transmitting logic block 2003 is electrically coupled to a support stem 2004 to provide a connection to main electronics unit 2006 containing a microprocessor controller (not shown in FIG. 20). A stylus 2007, which has a receiving antenna for receiving signals, is coupled to main electronics unit 2006. A base 2005 preferably supports the globe.

In some embodiments, the globe is a "talking globe apparatus" that is specifically designed for preschoolers. Preschoolers can explore the world and can learn about continents, oceans, animals around the world, unique landmarks and topography, languages, directions (e.g., north, south, east, and west), and regional music.

Figure 15:
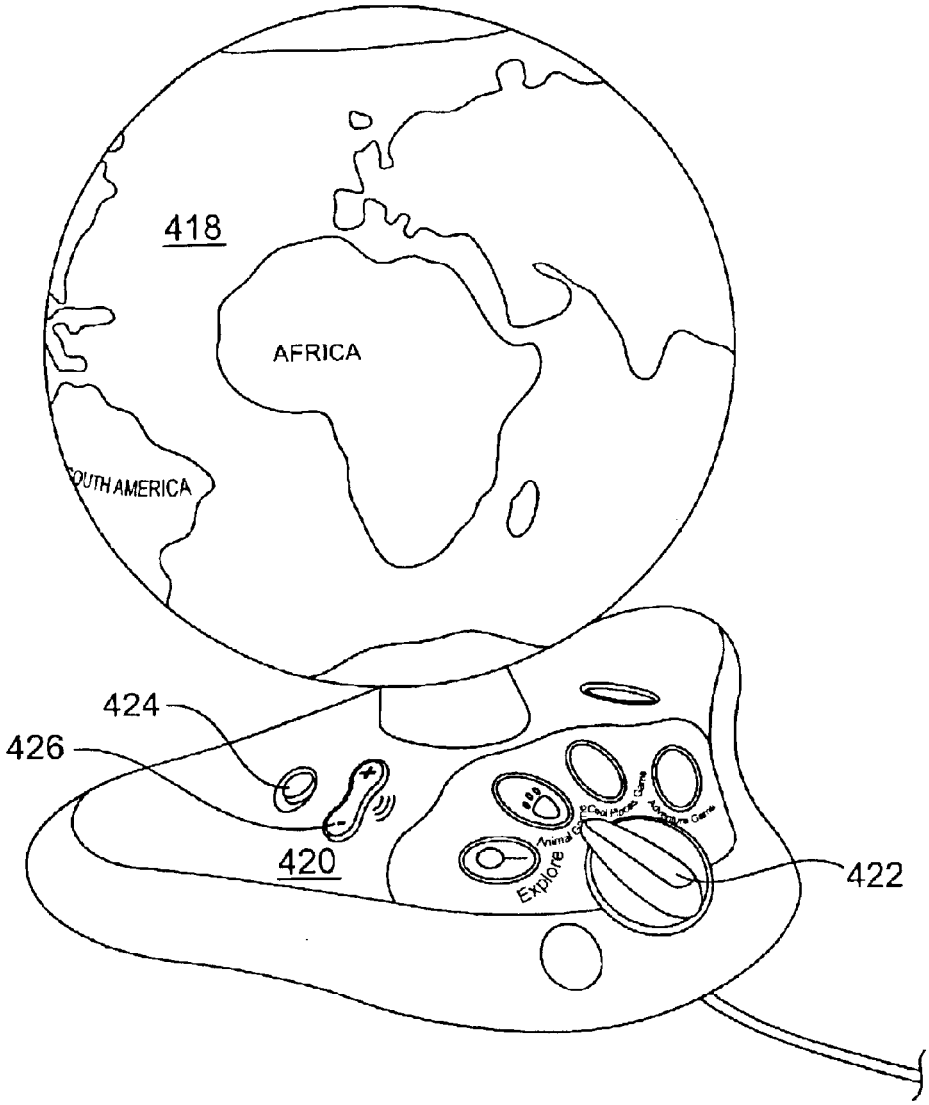
FIG. 15 shows the exterior of an exemplary globe apparatus according to an embodiment of the invention.

An exemplary talking globe apparatus is shown in FIG. 15. FIG. 15 shows a globe 418 on a base 420. The globe 418 can rotate on the base 360 degrees. A mode selector knob 422 and a volume switch 426 are included in the base 420. A repeat button 424 may also be provided in the base 420 so that the user can repeat any audio produced by the globe apparatus. Other details and audio scripts for talking globe apparatuses can be found in U.S. Provisional Patent Application No. 60/346,463, filed Jan. 5, 2002. This application is herein incorporated by reference for all purposes.

The knob 422 may be used to select one or more modes of operation. In embodiments of the invention, the globe apparatus (or any other interactive apparatus) can be preprogrammed with one or more operational modes. These modes may be preprogrammed into a memory in the globe apparatus. For example, in an exemplary embodiment, the globe has a first mode comprising an "Explore the World" mode. In this mode, amazing facts about the world can be learned. For example, a user can select an image of a continent, ocean, animal, or a natural or man-made wonder to hear up to five facts about each image. The globe may also have a second mode comprising a "Seek & Find" mode. In this mode, the globe may interrogate the user to find a particular image (e.g., a relief or non-relief image) that is on the globe. For example, a speech synthesizer in the globe may ask the user to "find the large mammal that swims in the ocean." In response, the user may select the image of a whale on the globe as the correct answer. The globe may also have a third mode comprising a "Music Mode". In this mode, the user can select an image of a country with a stylus. An example of the regional music of the particular country could then be played for the user. Each "hot spot" has its own piece of music, and the music is representative of the image at that spot. For example, spots in Asia may trigger Asian-sounding music when selected. Spots in Australia may trigger Australian or Bushman-sounding music when selected. In a fourth mode, a user can create an adventure song by selecting images on the globe to a musical backbeat. The user may select any of these modes by using a knob at the base of the globe apparatus.

In another embodiment of the invention, an instructional interactive globe may include a spherical globe having an interior volume and an outer surface and a map image on the outer surface. An antenna device located in the interior volume of the globe. A base supporting the globe wherein the base has an interior volume. A processor can be operatively coupled to the antenna device. A programmable memory can be operatively coupled to the processor. A stylus including a receiving antenna can be coupled to the processor, and a speaker can be operatively coupled to the processor. Switching circuitry can be operatively coupled to the processor and coupled to a selecting device such as a knob located on the exterior of the base. A plurality of preprogrammed operational modes is stored in the programmable memory, each preprogrammed operational mode correlating a preprogrammed audio response with the position of the switch and the location of the stylus on the map image.

When a user touches the stylus to a location on the globe, audio information about the location is produced through the speaker, the audio information including languages, music, animal life, and basic geography, and wherein the user may select one or more of the preprogrammed operational modes. At least one of the following preprogrammed operational modes can be included: (i) the declaration of facts, (ii) the quizzing about locations and facts associated with locations, and (iii) the generation of a unique trip simulation by touching the stylus to arbitrary locations of the user's choice to create a trip sequence and learning sequence unique to the user. In this latter mode (iii), a user may select, for example, three different "hot spots" on a globe. The order of selection may create a trip sequence. This trip sequence can be recorded in memory and audio or visual information about the particular trip sequence created by the user can be presented to the user. The programming for these and other modes for an interactive globe can be performed by those of ordinary skill in the art.

The terms and expressions which have been employed herein are used as terms of description and not-of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention. For example, it is understood that any of the described globe elements could use any of the described electrographic position location apparatuses and any specific features of those electrographic position location apparatuses without departing from the scope of the invention. In another example, the grounding structure shown in FIG. 3(*d*) may be used in any antenna device embodiments without departing from the scope of the invention. Other features of the specifically described embodiments can also be combined in any suitable manner while still being within the scope of the invention.

What is claimed is:

1. An electrographic position location apparatus comprising:

(*a*) a first antenna device comprising a plurality of first antenna members comprising a first plurality of first plate structures, a first plurality of second plate structures, and a first plurality of conductive members;

(b) a second antenna device comprising a plurality of second antenna members comprising a second plurality of first plate structures, a second plurality of second plate structures, and a second plurality of conductive members, wherein portions of the first plurality of conductive members and the second plurality of conductive members overlap to define an active area;

(c) an output device;

(d) a processor operatively coupled to the first antenna device, the second antenna device, and the output device; and (e) a stylus operatively coupled to the processor, wherein the first plurality of conductive members include conductive fingers, wherein the second plurality of conductive members include conductive fingers, and wherein the conductive fingers of the first and second pluralities of conductive members overlap.

2. The electrographic position location apparatus of claim 1 wherein the first and second antenna devices are under a planar surface of a housing.

3. The electrographic position location apparatus of claim 1 wherein the first and second antenna devices are in a three-dimensional housing.

4. The apparatus of claim 1 wherein the output device comprises a speaker.

5. The apparatus of claim 1 wherein the stylus comprises a receiving antenna.

6. The apparatus of claim 1 wherein the conductive fingers of the first plurality of conductive members and the conductive fingers of the second plurality of conductive members are separated by a dielectric layer.

7. The apparatus of claim 1 wherein the first plurality of first plate structures in the first antenna device is embodied by a single conductive structure that overlaps the first plurality of conductive members.

8. The apparatus of claim 1 further comprising an alternating voltage source coupled to the first plurality of plate structures.

9. The apparatus of claim 1 wherein the apparatus is an interactive talking book device.

10. The apparatus of claim 1 wherein the apparatus is an interactive talking book device, and wherein the apparatus further comprises a book disposed over the conductive fingers of the first plurality of conductive members and the conductive fingers of the second plurality of conductive members.

11. The apparatus of claim 1 wherein the apparatus is a talking globe.

12. The apparatus of claim 1 wherein the stylus comprises a receiving antenna and the apparatus is a globe.

13. The apparatus of claim 1 wherein the apparatus comprises a plurality of preprogrammed operational modes.

14. An electrographic position location apparatus comprising:

(*a*) a first antenna device comprising a plurality of first antenna members comprising a first plurality of first plate structures, a first plurality of second plate structures, and a first plurality of conductive members;

(b) a second antenna device comprising a plurality of second antenna members comprising a second plurality of first plate structures, a second plurality of second plate structures, and a second plurality of conductive members, wherein portions of the first plurality of conductive members and the second plurality of conductive members overlap to define an active area;

(c) an output device;

(d) a processor operatively coupled to the first antenna device, the second antenna device, and the output device; and (e) a stylus operatively coupled to the processor, wherein the first plurality of conductive members include conductive fingers with wing portions, wherein the second plurality of conductive members include conductive fingers, and wherein the conductive fingers of the first plurality of conductive members are under and overlap the conductive fingers of the second plurality of conductive members.

15. The electrographic position location apparatus of claim 14 wherein the first plurality of first plate structures in the first antenna device is embodied by a single conductive structure that overlaps the first plurality of conductive members.

16. An electrographic position location apparatus comprising:

(*a*) an antenna device comprising (i) a first plate structure; (ii) a second plate structure; (iii) a conductive member adapted to be capacitively coupled to the first plate structure at a first capacitance and adapted to be capacitively coupled to the second plate structure at a second capacitance, wherein the conductive member is adapted to transmit a signal; and (iv) a dielectric layer between the conductive member, and the first and second plate structures;

(b) a housing including a surface, wherein the housing houses the antenna device;

(c) an output device;

(d) a processor operatively coupled to the antenna device and the output device; and (e) a stylus operatively coupled to the processor, wherein the conductive member includes a third plate structure, a radiating region, and an elongated region between the third plate structure and the radiating region.

17. The apparatus of claim 16 wherein the third plate structure has an area greater than the first plate structure and the second plate structure combined.

18. The apparatus of claim 16 further comprising an alternating voltage source coupled to at least the first plate structure.

19. The apparatus of claim 16 wherein the output device comprises a speaker.

20. The apparatus of claim 16 wherein the housing is in the form of a platform.

21. The apparatus of claim 16 wherein the housing is in the form of a platform and wherein the apparatus further comprises a book on the platform.

22. The apparatus of claim 16 wherein the housing is in the form of a globe, and wherein the output device is a speaker.

23. The apparatus of claim 16 wherein the apparatus comprises a plurality of preprogrammed operational modes.

24. The apparatus of claim 16 wherein the stylus comprises a receiving antenna.

25. The apparatus of claim 16 wherein the first plate structure and the second plate structure are shaped as rectangles.

26. An electrographic position location apparatus comprising:

(*a*) an antenna device comprising (i) a first plate structure; (ii) a second plate structure; (iii) a conductive member adapted to be capacitively coupled to the first plate structure at a first capacitance and adapted to be capacitively coupled to the second plate structure at a second capacitance, wherein the conductive member is adapted to transmit a signal; and (iv) a dielectric layer between the conductive member, and the first and second plate structures;

(b) a housing including a surface, wherein the housing houses the antenna device;

(c) an output device;

(d) a processor operatively coupled to the antenna device and the output device; and (c) a stylus operatively coupled to the processor, wherein the first plate structure is part of a first conductor and wherein the first plate structure overlaps the conductive member by a first overlap area, and wherein the second plate structure is part of a second conductor and wherein the second plate structure overlaps the conductive member by a second overlap area, and wherein the first capacitance is based on the first overlap area and the second capacitance is based on the second overlap area.

27. The apparatus of claim 26 wherein the conductive member has an area greater than the first and second plate structures combined.

28. The apparatus of claim 26 further comprising an alternating voltage source coupled to at least the first plate structure.

29. The apparatus of claim 26 wherein the output device comprises a speaker.

30. The apparatus of claim 26 wherein the housing is in the form of a platform.

31. The apparatus of claim 26 wherein the housing is in the form of a platform and wherein the apparatus further comprises a book on the platform.

32. The apparatus of claim 26 wherein the housing is in the form of a globe, and wherein the output device is a speaker.

33. The apparatus of claim 26 wherein the apparatus comprises a plurality of preprogrammed operational modes.

34. The apparatus of claim 26 wherein the stylus comprises a receiving antenna.

35. The apparatus of claim 26 wherein the first plate structure and the second plate structure are shaped as rectangles.

36. The apparatus of claim 26 wherein the first plate structure is integral with the first conductor and the second plate structure is integral with the second conductor.

37. The apparatus of claim 26 wherein the first conductor and the second conductor are substantially linear.

* * * * *